United States Patent [19]

Cassidy

[11] Patent Number: 4,829,750

[45] Date of Patent: May 16, 1989

[54] FIREWOOD BUNDLING APPARATUS AND METHOD

[76] Inventor: Patrick A. Cassidy, P.O. Box 188, Big Sur, Calif. 93920

[21] Appl. No.: 37,965

[22] Filed: Apr. 14, 1987

[51] Int. Cl.[4] ..... B65B 13/02

[52] U.S. Cl. ..... 53/556; 53/390; 53/585

[58] Field of Search ..... 53/399, 585, 556 , 441, 53/390; 100/9

[56] References Cited

U.S. PATENT DOCUMENTS

| | | | |
|---|---|---|---|
| 2,026,289 | 12/1935 | Metternich | 53/585 |
| 2,236,936 | 4/1941 | Camp | 100/31 |
| 2,882,660 | 4/1959 | Denton | 53/135 |
| 3,264,796 | 8/1966 | Tomczak | 53/585 |
| 3,386,371 | 6/1968 | Farmer | 100/9 |
| 4,286,421 | 11/1981 | Fugio | 53/399 |
| 4,480,536 | 11/1984 | Burns | 53/585 |
| 4,514,966 | 5/1985 | Konstantin | 53/585 |

FOREIGN PATENT DOCUMENTS

| | | | |
|---|---|---|---|
| 2149747 | 6/1985 | United Kingdom | 53/585 |

*Primary Examiner*—John Sipos

*Attorney, Agent, or Firm*—Van W. Smart

[57] ABSTRACT

The invention is a method and apparatus, powered solely by the muscles of a single male adult during a working day; for bundling cut firewood, or the like. The apparatus is located under and over the top of a rugged rectangular work bench. The frame is constructed of welded metal rods, about an inch and a quarter in diameter. The operator can load the apparatus onto a flat bed of a motor vehicle for transport over open roads and across country. The operator faces a full length raceway below the top of the long panel. A lever arm protudes from the raceway toward the operator. A pivot is welded across the raceway, a foot or so back of the pannel. A loose fitting sleeve cover is over th pivot. The lever arm is welded to the loose fitting sleeve cover, its fulcrum. A chain linkage is welded to an end of the lever arm and to the foot of the elevator rod. The chain linkage forms a loop between the two. As the operator treads downwardly on the lever arm, the chain linkage shortens and in so doing drives the elevator rod and its attached elevator rod carriage, perpendicularly above the work bench. Before the latter movement starts, the operator places wide resilient rubber bands salvaged from used truck tire inner tubes, over the terminal removeable rods, in removeable rod sleeves, on the elevator rod carriage and under the corresponding fixed (stationary) rods welded to the top of the work bench. He continues to tread down upon the lever arm until he has created sufficient space for the bundle he desires, whereupon, he "captures" the lever arm under the work bench, loads the firewood in the cubic space created by the stretched rubber bands, releases "capture", removes the removeable rods from the rod sleeves, removes the wide rubber bands form under the stationary rods, welded to the top of the work bench, tosses the bundle to the ground.

7 Claims, 5 Drawing Sheets

FIREWOOD BUNDLING APPARATUS AND METHOD

BACKGROUND OF THE INVENTION

1. Field of the Invention

Class 53, Package Making, 399 Banding.

Class 100, Presses, 9, Preformed Continious Annular Binders.

Class 144, Woodworking, 192, Splitting and Bundling.

2. Background Art

Increasingly, urban householders are supplementing their home heating requirements by use of cut firewood from distant forests. Many of these householders get aesthetic enjoyment from the sounds and aroma of wood burning in their fire places and are willing to pay more for household heat when they have increased enjoyment from the sound and sight of burning wood. One sees an increased number of retail outlets for bundled firewood in their communities. There are increased numbers of forest wood lots to supply such householders. The chain of distribution from the forest wood lot is through one or more wholesale distributing firms, which of necessity, maintain tall stacks of bundled fire wood. Prior to our invention a material number of bundles broke and spilled. They had to be reconstuted because retailers would not accept broken bundles. The earliest attempt to deal with the broken bundle problem was to package wood in cardboard containers. The popular retail package is about a cubic foot of firewood. The cost of a cardboard container of such size is from 60 cents to a dollar, the heat value of a used cardboard container is minimal. Some wood lot operators have tried to bundle firewood with twine, cord or wire. Neither expedient has been successful. Cord lacked the resiliency to tighten bundles and did not cover a sufficient cross-section area of wood in a bundle to prevent pieces of wood from working free from the bundle. Once, one or a few pieces of firewood, became free from the bundle, the bundle collapses.

The advantage of the present invention is, the wood bundling apparatus is rugged and it is set in a rugged frame, which is a workbench, that withstands bending and misalignment of the moving parts, when operations are over rough terrain, where the workbench is certain to tumble and fall frequently. The workbench and the frame members are made of heavy steel or iron tubing. Except for convenience of shipping, no parts are thread joined. They are fitted, so that rust or corrosion will not prevent operation. Hard falls will not result in misalignment. Lubrication is unnecessary.

The assembled apparatus of the present invention, including the work bench frame and the bundling mechanism, can easily be moved for short distances, by one male adult. Also, such a person can lift the combined work bench frame and bundling mechanism upon the flat bed of a motor vehicle, for transport over open roads and across country.

Furthermore, the only power required for the bundling operation are the arm and leg muscles of the operator. The average adult male operator can bundle firewood for practically a full working day. The bundles of firewood are bound by thick, wide rubber bands salvaged from truck tire inner tubes, under tension, making it practically impossible for the bundles to break during transportation.

BRIEF SUMMARY OF THE INVENTION

The apparatus and functions claimed for this invention are best described by brief reference to FIG. 1 of the drawings. FIG. 1, shows the construction of the work bench and the relative positions of most of the working parts. Corrosion cannot create stopage. Extraordinary outside impact on the frame members will not bend the frame to restrict the clearance of moving parts. The rods and tubes comprising the frame have an outside diameter of about 1¼ inches and an inside diameter of about an inch. The walls are about an eighth of an inch thick. Lubrication of the moving parts is not required for routine maintenance. The apparatus need not be stored under cover to prevent weather damage. Where tubes are used, instead of rods, for the work bench, as has been said; they are thick walled.

The apparatus is made to have a capacity for bundling about a cubic foot of firewood, the most popular quantity. However, with slight modification, it can be made made to bundle a half cubic foot, another popular quantity.

The bundles are bound with thick, wide, resilient rubber bands, salvaged from used truck tire inner tubes. There are large quantities available everywhere at very little cost. No machinery, aside from a sharp knife, is necessary. The operator cuts the inner tubes into cross section bands varying from about 2½ to 3 inches.

The bundling apparatus of this invention can be used to bundle shingles, shakes, stakes, newspaper, and numerous other natural or manufactured products that are not easily fractureable or permanently compressible.

Part 1, is the foot crank. (FIGS. 1, 2, 3, 4, 5)

Part 2, is the lever arm. (FIGS. 1, 2, 3, 4, 5)

Figure 1:
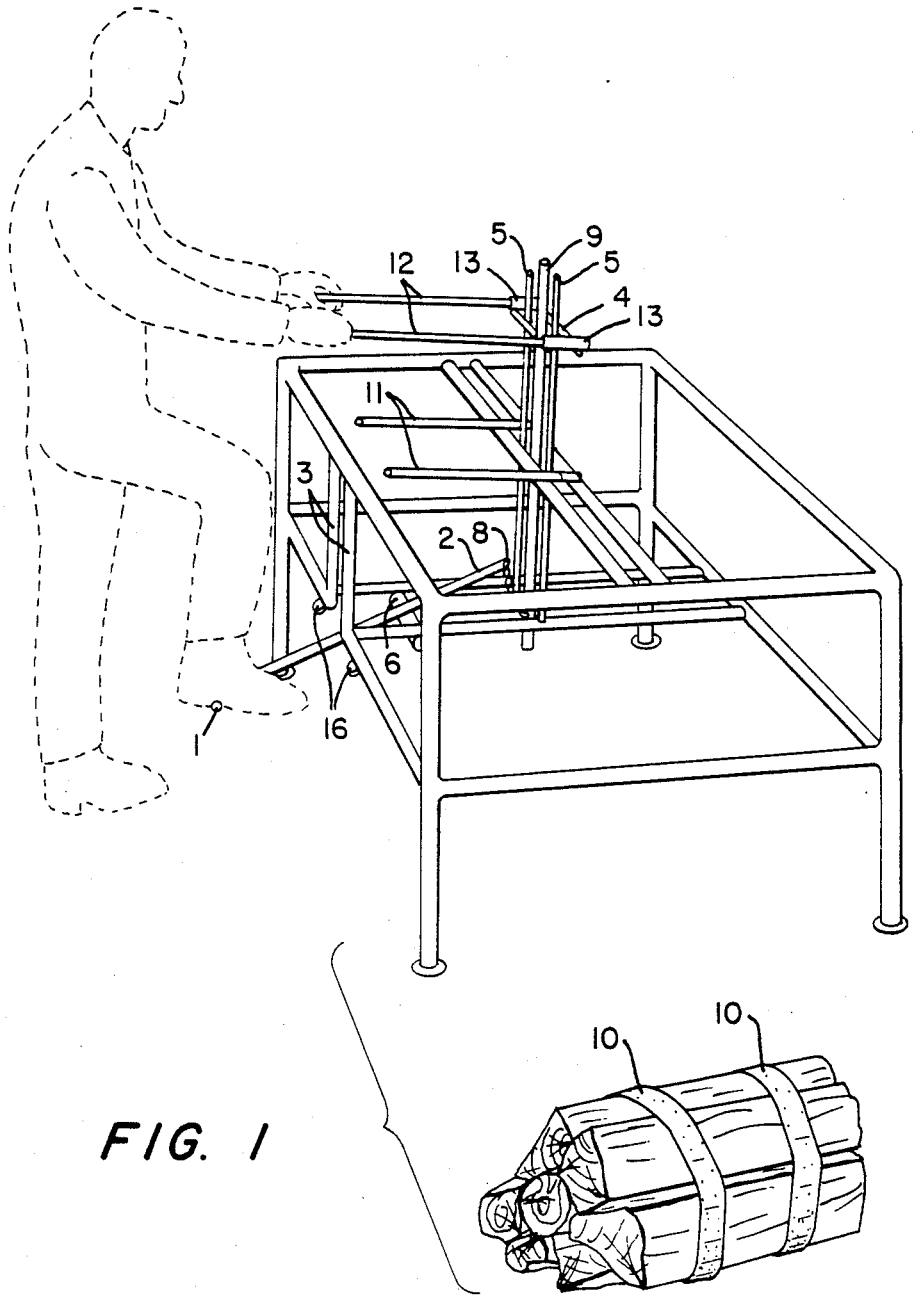
FIG. 1, is a perspective of the operator standing in front of the raceway of the apparatus of the invention. It shows a bundle of firewood in the foreground.
Figure 2:
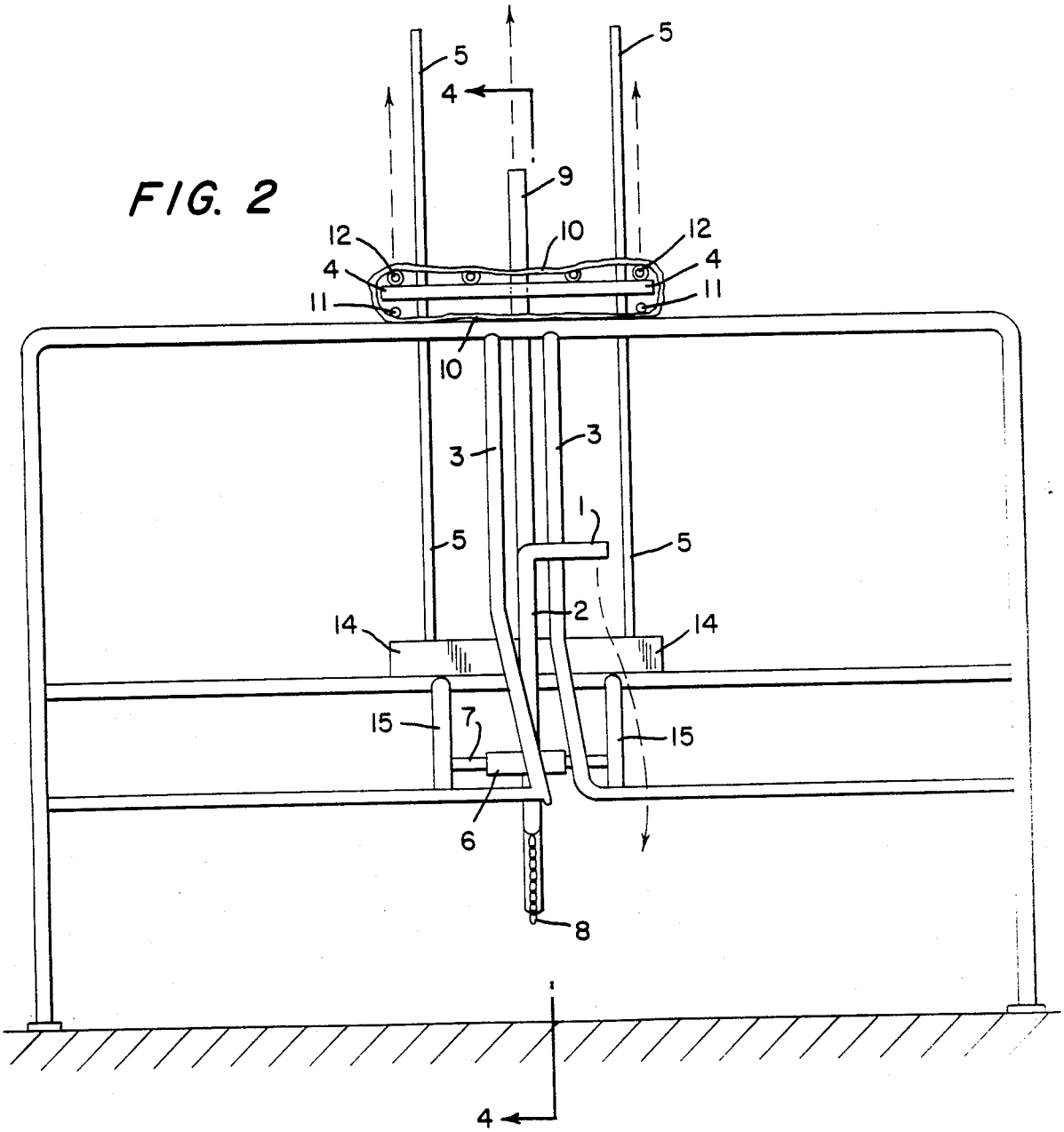
FIG. 2, is a two dimensional sketch of the apparatus, through the center of the length before the operator has started to depress the foot crank, 1.
Figure 3:
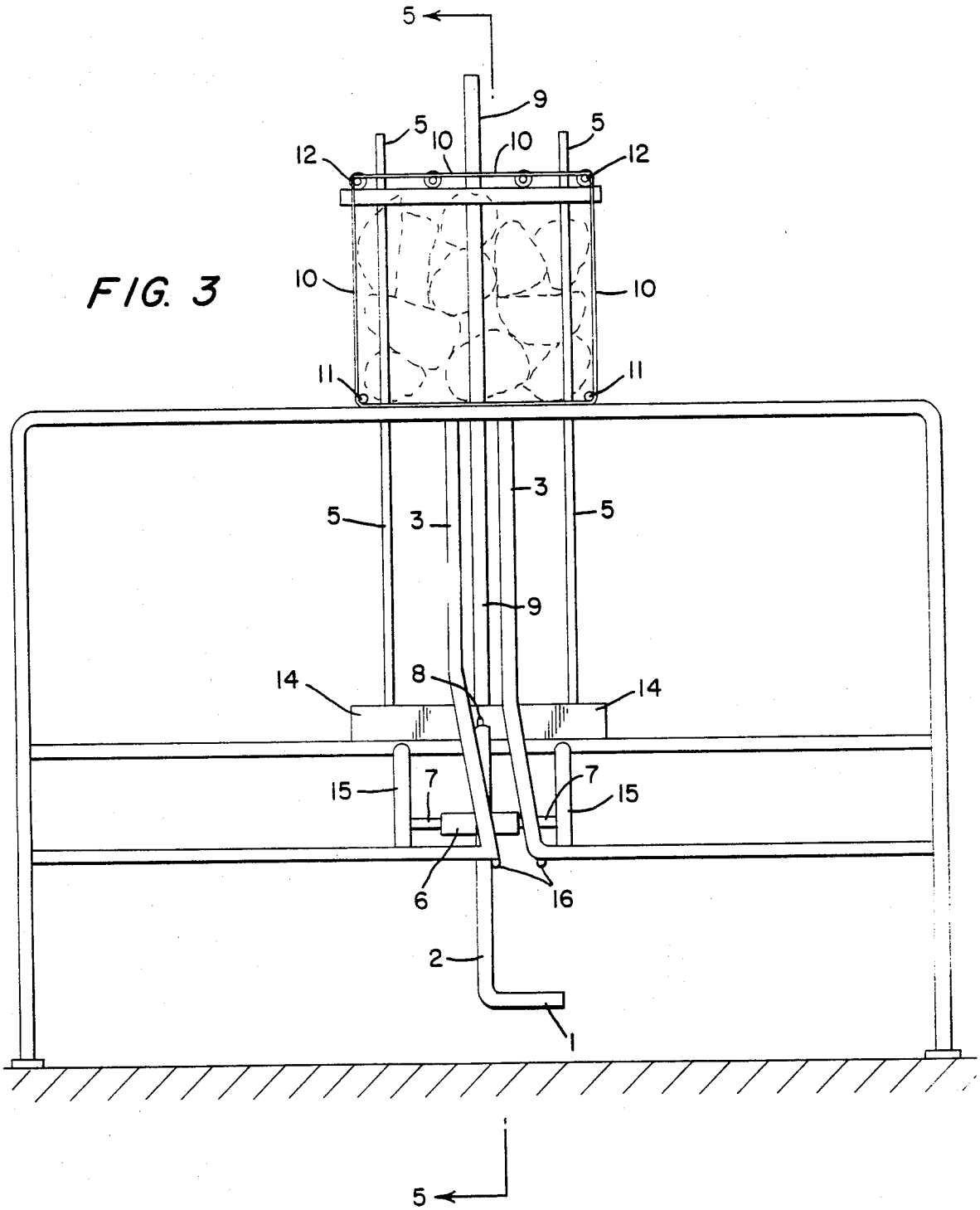
FIG. 3, is a two dimensional sketch of the apparatus, through the center of the length, after the operator has "captured" the foot lever arm 2, under the frame of the workbench just past the raceway, after the firewood has been been stacked.

Part 3—3, is the raceway. (FIGS. 1, 2, 3)

Part 4, is the elevator rod carriage. (FIGS. 1, 2, 4, 5)

Part 5, are the guide rods, of which there are two. (FIGS. 1, 2, 3)

Part 6, is the loose fitting sleeve cover. (FIGS. 1, 2, 3, 4, 5)

Part 7, is the pivot shaft. (FIGS. 2, 3, 4, 5)

Part 8, is the chain linkage; attached to parts, 2. and 9. (FIGS. 1, 2, 3, 4, 5)

Part 9, is the elevator rod. (FIGS. 1, 2, 3, 4, 5)

Parts 10, are the wide elastic rubber bands recycled from truck tire inner tubes. (FIGS. 2, 3, 4, 5)

Parts 11, are the fixed (stationary) rods welded to the bench frame. (FIG. 1)

Parts 12, are the removeable rods. (FIGS. 1, 2, 3, 4, 5)

Figure 4:
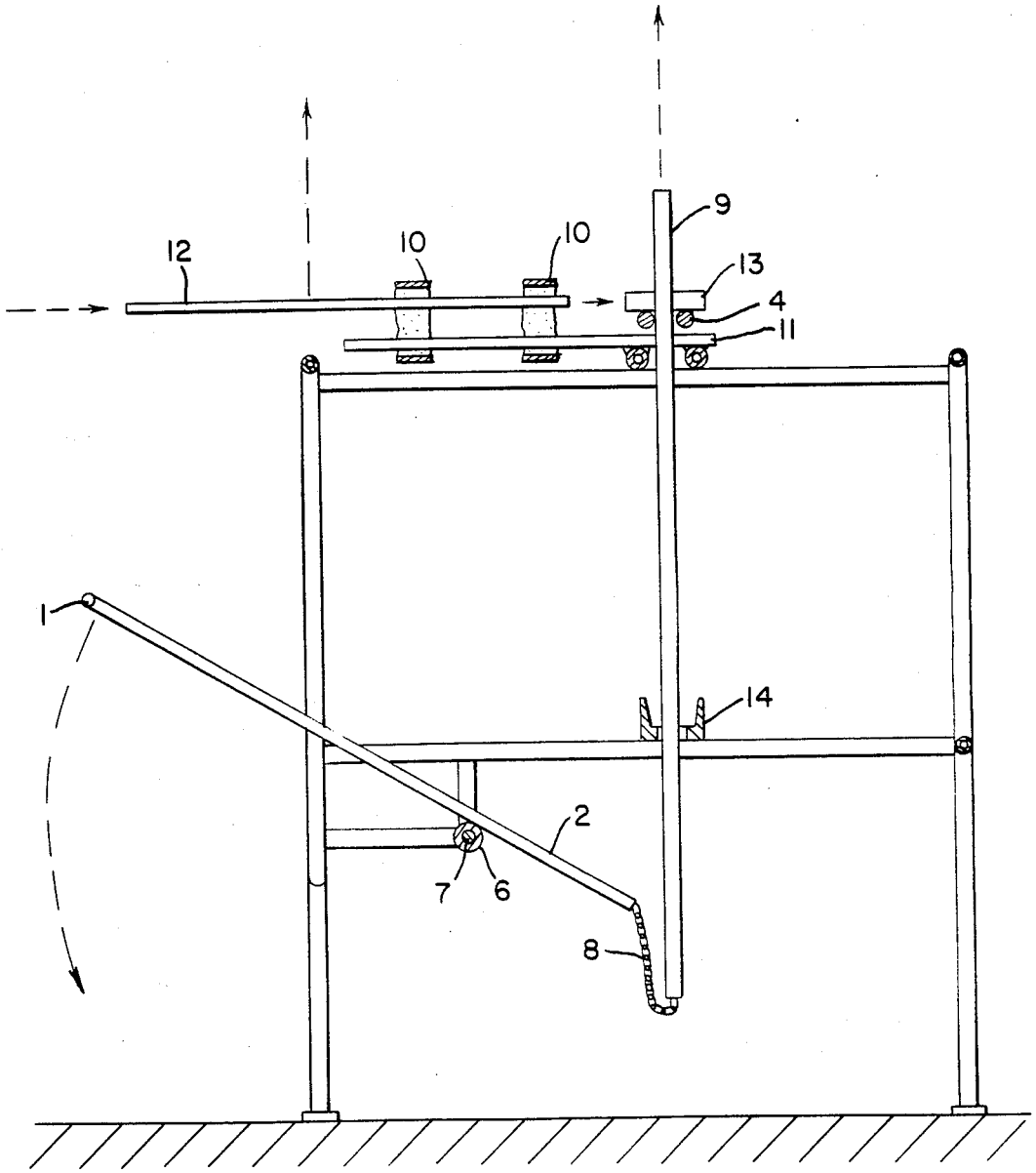
FIG. 4, is a two dimensional sketch of the apparatus through center of the width of the workbench, before the operator has started to depress the lever arm. The arrowheads joined by dashed lines show the direction of movement of parts when the operator treads downward on foot crank, 1.
Figure 5:
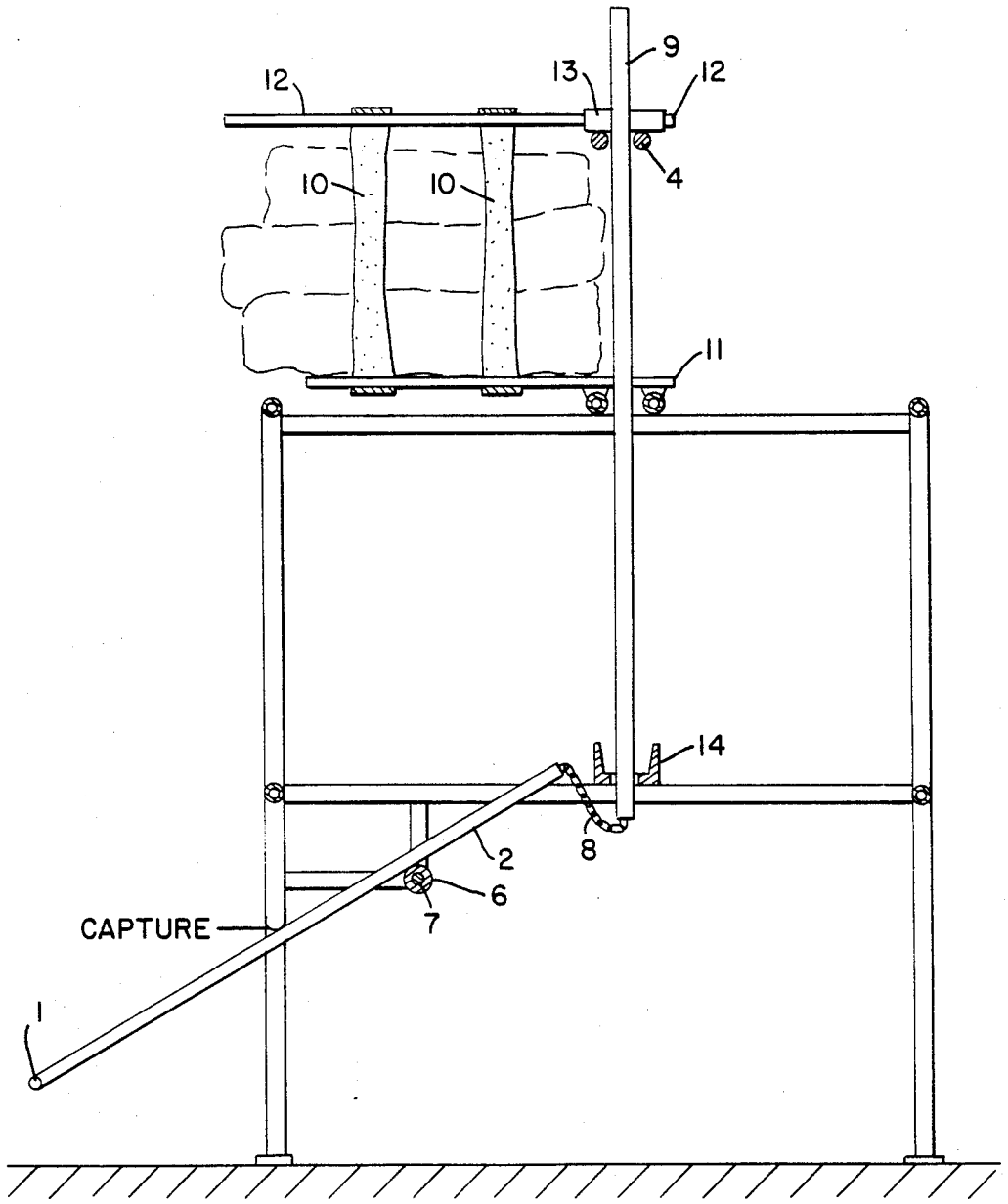
FIG. 5, is a two dimensional sketch of the apparatus showing conditions where the operator has completely depressed the foot crank 1, "captured" the lever arm, 2, under the frame of the workbench, has stacked the cut firewood.

Parts 13, are the removeable rod sleeves. (FIGS. 1, 4, 5)

Parts 14, is the guide base, to which the guide rods are welded. (FIGS. 2, 3)

Parts 15, are the guide supports. (FIGS. 2, 3)

Parts 16, are the "capture rod" retaining rings. (FIGS. 1, 3)

Similar parts in whatever figs. they appear have the same numbers. FIG. 1 is a large scale perspective of the firewood bundling apparatus of the present invention. The apparatus is contained within and upon a rectangular work bench, that stands off the ground on pipe and plate legs. The operator is shown in in dashed lines standing before the central raceway, 3—3. The long side of the bench is between 5 and 6 feet. The short side is about four feet.

The operator's right foot has depressed the foot crank, 1, through the raceway, 3—3, below the pair of parts, 16, the "capture" rod rings. The "capture" rod or bar, may be a tire iron, or the like.

The operator's downward tread on the foot crank, 1, has rotated the foot lever arm, 2 welded to the loose fitting cover, 6, which in turn has shortened the chain linkage, 8 welded to the arm and to an elevator rod which carries and drives the elevator rod carriage, 4, with its removeable rods, 12, upwardly. This stretches the wide elastic rubber bands between the removeable rods, 12, and the fixed (stationary), 11. This creates a cubic space above the surface of the work bench, for the cut firewood that is to be bundled, to be stacked, for bundling, which occurs when the wide resilient rubber bands, 10, snap over the stacked cut firewood.

FIGS. 2, 3, 4, and 5 are two dimensional schematic sketches, with the operator removed. They are on a much smaller scale than FIG. 1, to show more detail. The arrowheads attached to the dashed lines of FIGS. 2 and 4, show the direction of the movement of parts. The solid lines attached to arrowheads in FIGS. 2 and 3, show the direction of view. FIGS. 2 and 3 are sectional views taken along the length of the work bench. FIG. 2, shows the apparatus before the operator has tread down upon the foot crank, 1. The elevator rod carriage, 4, is resting on top of the center of the work bench. None of the structure of the elevator rod carriage, ahead of the plane of the drawing paper is shown. Four removeable rods, 12, are shown upon the elevator rod carriage. Two, fixed (stationary) rods are shown on the top of the work bench. The wide elastic rubber bands, 10, have not been stretched.

FIG. 3, is the companion to FIG. 2. The foot crank, 1, has been "captured" under the work bench frame by axially sliding the arm 2 and its cover 6 on the pivot shaft 7, under the left obtuse angle bent raceway 3, member. A cubic foot of firewood has been stacked within the stretched rubber bands, 10.

FIG. 4, is a cross section through the center of the width of the work bench. This schematic shows the conditions before the operator has started to press down upon the foot crank. The foot crank, 1, is in its highest position, upon its loose fitting sleeve cover, 6. The chain linkage 8, has not been shortened. The elevator rod 9, has not been raised. The wide elastic rubber bands have not been stretched, no wood has been stacked.

FIG. 5, is the companion schematic to FIG. 4. The operator has pressed down upon the foot crank, 1, sufficiently to create a space under tension, to stretch the wide resilient rubber bands, 10, to load a cubic foot of firewood. He has "captured" the lever arm, 2, under the work bench frame. All that remains to be done now, is to release "capture", remove the removeable rods, 12, from the removeable rod sleeves, 13; remove the the elastic rubber bands, 10, from under the fixed (stationary) rods, 11; and toss the bundled firewood off the work bench. The apparatus of the invention is now ready to commence a new cycle of bundling.

The scale of FIG. 1 is so large that there is not enough space to illustrate the wide resilient rubber bands, 10, stretched over the removeable rods, 12 and under the fixed (stationary) rods, 11. The scale of FIG. 1, is not small enough that the relationship of the removeable rods, 12, to the removeable rod sleeves, 13, can adequately be shown. Furthermore, the scale of FIG. 1, is so large that the relationships of the chain linkage, 8, to the lever arm, 2, and to the elevator rod, 9 and elevator rod 9's attachments can be understandably illustrated.

For these reasons, the outline of the operator has been dropped from succeeding figures of drawing, and the scale of the remaining figures of drawing have been greatly reduced.

FIG. 2, is a schematic of the length of the apparatus projected on a center plane of the drawing, that is to say; apparatus ahead of the plane of the paper of the drawing is not shown.

In FIG. 2, the arrowheads attached to broken lines, show the direction of movement of parts. Also, in FIG. 2, the arrowheads attached to solid lines, show direction of the observer's view.

A principal difference between FIG. 1, and the remaining FIGS. 2, 3, 4, and 5 is: in FIG. 1, the raceway, 3—3, is framed by rods that are straight and parallel for their full length and a pair of rings 16 welded on the frame are used to hold a tire iron or bar above a lowered lever arm to capture the arm. In FIGS. 2, 3, 4, and 5; the raceway rods are straight and parallel to about past the center of their length, where they are bent to the right at equal obtuse angles. The obtuse bend in both members of the raceway 3—3 help to guide the lever arm, 2, on its loose fitting sleeve cover, 6, under the frame of the work bench.

FIGS. 3, and 5, best illustrate "capture". The operator has placed, at least, a pair of wide elastic rubber bands over the removeable rods, 12, and under the fixed (stationary) rods, 11. When he treads downwardly on the crank, 1, the elevator rod, 9, raises and stretches the rubber bands, 10, into an empty cubical space. The operator needs his arms and hands to stack the cut firewood into the empty cubical space. If he takes his foot off the foot crank, 1, the cubic space will disappear by reason of the tension in the elastic rubber bands, 10. If, however, the operator does something to immobilize the foot crank, 1, he can take his foot off the foot crank and the wide resilient rubber bands will remain stretched. The operator has, also, freed his arms and hands, needed to stack the firewood in the space. This immobilization is given the name, "capture". Means of "capture" are limitless. They may be as simple as friction so great that parts stick after the foot upon the foot crank, 1, is released. The most reliable "capture" occurs when lever arm, 2, is shoved below the "capture" rod retaining rings, 16, and a tire iron, or the like, is passed through the rings.

I claim:

1. An apparatus for manually bundling cut firewood, shingles, shakes, stakes, articles of manufacture that are permanently compressible, not fracturable, into bundles bound by at least a pair of resilient rubber bands salvaged from used truck tire inner tubes which apparatus is under and over the top surface of a rectangular workbench frame made of about one and a quarter inch diameter metal tubing, with walls of about an eighth of an inch; which workbench is of a size and weight that one man can move it on and off the flat bed of a motor vehicle; said bundler comprises in combination: a vertical central raceway member formed by said frame through the width of the long panel of the workbench facing the operator; a horizontal pivot shaft welded underneath the workbench frame at a position back of the front of the workbench frame; a loose fitting sleeve cover mounted over said pivot shaft; a lever arm welded on top of the sleeve cover and movable within said raceway, which lever arm has a crank at the operator end; a chain linkage welded to the opposite end of said arm; a vertical elevator rod mounted in the frame for vertical movement and attached to said chain; a horizontal elevator rod carriage mounted on said elevator rod and carrying on its terminal ends removeable rods within sleeves distanced sufficiently apart to produce a bundle of a desired size; fixed rods corresponding to the removeable rods and welded to the top of the workbench and a pair of retaining rings welded to the workbench frame under the raceway to retain a removeable bar; so that when the operator places a wide resilient rubber band salvaged from used truck tire inner tubes over said removeable rods on the elevator rod carriage and under said corresponding fixed rods and presses downwardly on the crank to move it below the retaining rings, said opposite end of the lever arm rises shortening the chain linkage, which in turn drives upwardly the elevator rod, the carriage and the removeable rods to stretch the rubber band in a space of about a cubic foot above the top of the workbench; thereafter, the operator captures and maintains the cubic space by passing said bar through said rings and over the lever arm 9 to allow the stacking of the articles within said space after which the banded bundle is removed from under the fixed rods and tossed on the ground to even its ends; the operator then raises the foot crank against the workbench frame preparatory to the start of a new bundling cycle.

2. The apparatus of claim 3, where capture is achieved by the operator exerting downward pressure on the lever arm while he is sliding it on the loose fitting sleeve cover past the raceway, he increases his downward pressure until after the lever arm has passed the raceway and is under the frame of the workbench, whereupon the operator releases his pressure on the lever arm; it snaps closed, "captured" by the workbench frame.

3. Apparatus for bundling firewood of length between 4 and 24 inches into bundles from a fraction of a cubic foot to about a cubic foot, comprising in combination;

A. a rectangular workbench made of welded metal tubing of one and a quarter inches outside diameter with walls about an eighth of an inch thick;

B. the workbench is about three feet wide and about four and a half feet long;

C. the workbench stands off the ground on legs with metal plates welded upon the ends;

D. a vertical raceway member formed by said frame through the center of the long panel which the operator faces;

E. a pivot shaft that is welded to the workbench frame across the bottom of the raceway;

F. a loose fitting sleeve cover mounted over said shaft for pivotal and axial movement along said shaft;

G. a lever arm, having a crank at one end, welded to said sleeve cover and moveable in said raceway;

H. a chain linkage, one end of which is welded to the end of the lever arm;

I. a vertical elevator rod mounted in the frame for vertical movement and attached to said chain;

J. a horizontal elevator rod carriage mounted on said elevator rod and carrying on its terminal ends removeable rods within sleeves distanced sufficiently apart to produce a bundle of a desired size and fixed rods corresponding to the removeable rods and welded to the top of the workbench;

whereby when the operator presses downwardly on the foot crank, the elevator rod, its carriage and the removeable rods start to rise stretching at least a pair of approximately two inch wide resilient rubber bands, salvaged from resilient used truck tire inner tubes, which rubber bands have been placed over the removeable and fixed rods; after the stretch in the resilient rubber bands is sufficient to bundle the desired quantity of firewood, the operator captures the lever arm by axially moving the foot crank along its pivot shaft under the frame of the workbench at the bottom of the raceway, whereupon the operator stacks the firewood in the cubic space defined by the motionless rubber bands over the top of the workbench; releases capture by removing the lever arm from under the frame of the workbench; withdraws the removeable rods from the removeable rod sleeves, removes the banded bundle from the fixed rods; tosses the end of the bundle on a hard surface of the ground to even protruding ends; whereafter the operator rests the foot crank upwardly on the frame of the workbench in readiness for a new bundling operation.

4. The apparatus of claim 1, where the raceway members are parallel to about past their their center, whereafter they remain parallel but are at an obtuse angle.

5. The apparatus of claim 1, where capture is accomplished on metal tabs welded to the sides of the raceway members.

6. The apparatus of claim 1, said lever and raceway having matching apertures in the lever arm and the raceway members; whereby, when a cable with friction tightening means and loosening means on its ends are passed through such apertures, capture occurs.

7. The apparatus and method of claim 1, a removeable rod sleeve is welded on the elevator rod carriage midway between the pair of terminal rod sleeves, and corresponding stationary rods are welded on the surface of the workbench; whereupon, the operator places resilient wide rubber bands over the closest removeable rods, depresses the lever arm, captures about a cubic of space but only loads the space between the closest stretched rubber bands, with cut firewood, releases capture removes the stretched rubber bands, whereupon; about a half cubic foot of firewood is bundled.

* * * * *